US012162055B2

(12) United States Patent
Mücke et al.

(10) Patent No.: US 12,162,055 B2
(45) Date of Patent: Dec. 10, 2024

(54) TENSIONING PULLEY SET FOR A STRAIGHTENING LINE FOR STRAIGHTENING A STRIP, RE-ROLLING STAND LINE AND METHOD OF OPERATING A STRAIGHTENING LINE

(71) Applicant: VDEh-Betriebsforschungsinstitut GmbH, Düsseldorf (DE)

(72) Inventors: Gert Mücke, Hilden (DE); Roger Lathe, Düsseldorf (DE); Julian Kremeyer, Hilden (DE)

(73) Assignee: VDEh-Betriebsforschungsinstitut GmbH, Dusseldorf (DE)

( * ) Notice: Subject to any disclaimer, the term of this patent is extended or adjusted under 35 U.S.C. 154(b) by 330 days.

(21) Appl. No.: 17/534,087

(22) Filed: Nov. 23, 2021

(65) Prior Publication Data

US 2022/0176432 A1 Jun. 9, 2022

(30) Foreign Application Priority Data

Nov. 30, 2020 (DE) ..... 10 2020 007 286.0

(51) Int. Cl.
*B21B 37/48* (2006.01)
*B21D 1/02* (2006.01)

(52) U.S. Cl.
CPC ..... *B21B 37/48* (2013.01); *B21D 1/02* (2013.01)

(58) Field of Classification Search
CPC ..... B21B 37/52; B21B 37/48; B21B 39/08; B21B 39/082
See application file for complete search history.

(56) References Cited

FOREIGN PATENT DOCUMENTS

| | | | |
|---|---|---|---|
| DE | 2630410 | C2 | 1/1978 |
| DE | 4236657 | A1 | 5/1994 |
| DE | 19616980 | A1 | 10/1997 |
| DE | 19747655 | A1 | 5/1999 |
| DE | 19933610 | A1 | 1/2001 |
| DE | 10207501 | C1 | 10/2003 |
| DE | 202007001066 | U1 | 5/2008 |
| DE | 202014006820 | U1 | 11/2015 |
| DE | 102014012426 | A1 | 3/2016 |
| DE | 102018111627 | A1 | 7/2019 |

(Continued)

OTHER PUBLICATIONS

Machine Translation of EP1789211A (Year: 2007).*

*Primary Examiner* — Debra M Sullivan
(74) *Attorney, Agent, or Firm* — Howard IP Law Group, PC

(57) ABSTRACT

A tensioning pulley set for a straightening machine for straightening a strip or for a re-rolling stand for re-rolling a strip, comprising a first tensioning pulley with a first pulley axis and at least one second tensioning pulley with a second pulley axis, the first tension pulley being a flatness measuring pulley having a force sensor for measuring a radial force applied to the circumferential surface of the flatness measuring pulley, and a drive for the second tensioning pulley with which a torque can be applied thereto on the second pulley axis, either the first tensioning pulley configured without a drive, or an auxiliary drive provided for the first tensioning pulley with which a torque can be applied to the first tensioning pulley on the first pulley axis, the auxiliary drive for the first tensioning pulley being significantly weaker than the drive for the second tensioning pulley.

11 Claims, 3 Drawing Sheets

(56) References Cited

FOREIGN PATENT DOCUMENTS

| | | | | | |
|---|---|---|---|---|---|
| DE | 102018009611 | A1 | | 6/2020 | |
| DE | 102019006788 | | | 4/2021 | |
| EP | 1469955 | B1 | | 10/2004 | |
| EP | 1789211 | | | 5/2007 | |
| EP | 1789211 | A1 | * | 5/2007 | ..... B21B 38/02 |
| GB | 1409025 | A | * | 10/1975 | ..... B21D 1/05 |
| KR | 101510535 | B1 | | 4/2015 | |
| WO | 03061865 | A1 | | 7/2003 | |
| WO | WO2020120328 | A1 | | 6/2020 | |
| WO | WO2020120329 | A1 | | 6/2020 | |

* cited by examiner

TENSIONING PULLEY SET FOR A STRAIGHTENING LINE FOR STRAIGHTENING A STRIP, RE-ROLLING STAND LINE AND METHOD OF OPERATING A STRAIGHTENING LINE

FIELD OF INVENTION

The invention relates to a tension pulley set for a straightening system for straightening a strip. Further, the invention relates to a straightening device for straightening a strip. Furthermore, the invention relates to a re-rolling stand for re-rolling a strip. The invention also relates to a method for operating a straightening system or a rolling stand system.

BACKGROUND

Increasingly higher demands are being placed on the quality of products and semi-finished products made from sheets and strips material. The various customers require metal sheet products that are subject to very tight low tolerances for optical and process engineering reasons. A key quality feature of sheet products is their flatness. Due to various influences, this flatness requirement is very often not met during rolling. Tape straightening processes are therefore used subsequently to eliminate the unevenness. Length compensation is achieved by plastic stretching of the shorter parts of the band in the band. For example, this can eliminate center or edge waves. In this process, the strip sections, which were of different lengths and therefore partly wavy before the straightening process, are plastically elongated in different ways.

For the straightening of strips, continuous straightening processes are regularly used, which are differentiated in terms of their mode of operation into stretch-bend straightening, tension-stretching or a combined tension-stretching and stretch-bend straightening. What all three have in common is that they exhibit

- infeed tensioning pulley sets, in which the belt tension is increased when compared to the belt tension in the line,
- a stretching zone or a stretch-bending frame and
- a run-out tensioning pulley set, in which the strip tension is reduced back to the level of the line.

In order to adjust the stretching zone or/and the bending stand optimally, it is necessary to measure the flatness of the strip continuously.

In the stretching zone, or before or after the bending stand, installation conditions are usually very cramped. Similarly, cramped installation conditions prevail between the outlet tensioning pulley set and, for example, a rewinder.

From EP 1 789 211 B1 it is known that there is a strip treatment installation with a pair of tensioning pulleys, in which the strip is guided over a tensioning pulley of the pair of tensioning pulleys and the strip tension is increased or reduced by the tensioning pulley between the entry onto the tensioning pulley and the exit from the tensioning pulley, wherein the tensioning pulley has at least one measuring sensor arranged at the circumference of the tensioning pulley for detecting the tension distribution in the strip.

From DE 10 2018 111 627 A1, it is known that a stretch-bend leveler with a feeding means for feeding a strip-shaped material along a running direction into a high-pull region and a low-pull region, where the low-pull region is arranged downstream of the high-pull region in the running direction. In the mentioned stretch-bend-straightener, a bend-straightener unit is provided, which is located in the high-tension area. Furthermore, it is known that at least one measuring system for determining a first measured value in the high tensile range exists. It is provided that, in addition, at least one measuring system is provided for determining a second measured value in the pull-down area.

SUMMARY

Against this background, the invention was based on the task of proposing a tensioning pulley set for a straightening line for straightening a strip or for a re-rolling stand for re-rolling a strip, the use of which in a straightening line allows straightening of the strip or the use of which in a re-rolling stand allows the re-rolling to be carried out more effectively.

The invention is based on the basic idea of designing a tensioning pulley for the tensioning pulley set, as proposed in EP 1 789 211 B1, as a flatness measuring pulley, whereby the tensioning pulley set is further formed according to the invention in such a way that although a drive is provided for the second tensioning pulley, with which a torque can be applied to the second tensioning pulley on the second pulley axis, but according to the invention, the first tensioning pulley is either designed without a drive or an auxiliary drive is provided for the first tensioning pulley, with which a torque can be applied to the first tensioning pulley on the first pulley axis, but this auxiliary drive for the first tensioning pulley is designed to be weaker than the drive for the second tensioning pulley.

It has been shown that in the case of tensioning pulleys fitted with drives, the drive often supplies the required torque on one side via the bearing journal of the tensioning pulley. When the strip tension is applied, the torque applied to the tension pulley via the drive counteracts the strip retraction, with the result that the pulley body of the tension pulley and any coating material present are deformed or twisted in the elastic range. Such a deformation of the pulley body of the tensioning pulley and of the coating material, if present, can falsify the measurement of the force sensor.

According to the invention, this measurement error can be avoided or reduced if the first tensioning pulley, which is designed as a flatness measuring pulley, is either designed without a drive or is only equipped with a weaker auxiliary drive. As a result, when such a tensioning pulley set is used in a straightening line, the straightening of the strip can be carried out better because the measurement results of the flatness measuring pulley are better. Likewise, when such a set of tension rolls is used in a re-rolling stand, the re-rolling of the strip can be carried out better, since the measurement results of the flatness measuring roll are better.

The invention is directed to a set of tension pulleys for a straightening machine for straightening a strip. It is to be expected that the advantages of the invention are already achieved with a set of pulleys comprising only a first tensioning pulley and a second tensioning pulley. However, according to the invention, the tensioning pulley set preferably comprises a first tensioning pulley, a second tensioning pulley and a third tensioning pulley, in particular and in addition preferably a fourth tensioning pulley and even more preferable a fifth tensioning pulley and very specifically preferable an addition of a sixth tensioning pulley.

As also proposed in EP 1 789 221 B1, the first tension pulley is a flatness measuring pulley having a force sensor for measuring a radial force applied to the circumferential surface of the flatness measuring pulley.

Embodiments are conceivable in which the tensioning pulley set has several flatness measuring pulleys, as described for example in DE 10 2019 006 788. In a preferred embodiment, however, the tensioning pulley set has only a single flatness measuring pulley. This limitation to a single flatness measuring pulley within the tensioning pulley set can reduce the expenditure for tensioning pulley sets.

The flatness measuring pulley can be of the type described in DE 42 36 657 A1 or of the type described in DE 196 16 980 A1 or of the type described in DE 102 07 501 C1 or of the type described in DE 20 2007 001 066 U1 or of the type described in EP 1 469 955 B1. Furthermore, the measuring pulley can be of the type described in WO2020/120328 A1 or of the type described in WO2020/120329 A1.

The measuring pulley has a measuring pulley body. Preferably, the measuring pulley body has a closed circumferential surface. In a preferred embodiment, the measuring pulley body is a solid pulley extending along a longitudinal axis. A solid pulley is understood to be a measuring pulley body which is in one piece and its shape has been produced either by a primary forming process, for example casting, and/or its geometric shape is produced from a one-piece semi-finished product by cutting processes, in particular by machining, especially by turning, drilling, milling or grinding. In a preferred embodiment, in such a measuring pulley body designed as a solid pulley, the measuring pulley pivots arranged in each case on the end face of the measuring pulley for rotatable mounting of the measuring pulley, for example in ball bearings, are also part of the one-piece body. However, designs such as those shown in FIG. 2 of DE 20 2014 006 820 U1 are also conceivable in which the main part of the measuring pulley body is designed as a cylindrical solid pulley which has covers arranged on the end faces on which the measuring pulley pivots are designed. Furthermore, the measuring pulley body can be designed, for example, like the measuring pulley body shown in FIG. 3 of DE 20 2014 006 820 U1, in which the measuring pulley body is designed with integrally formed pins and a sheath tube is pushed over the measuring pulley body. In a particularly preferred embodiment, however, the measuring pulley does not have a sheath tube, but is designed as a solid pulley. embodiments are conceivable in which the measuring pulley body is formed from individual discs arranged side by side, as shown for example in DE 26 30 410 C2.

The measuring pulley body of the measuring pulley preferably has a closed circumferential surface. This can be achieved, for example, by forming the measuring pulley body as a solid pulley and by forming all cavities which are provided in the measuring pulley body in such a way that none of the cavities lead from the cavity to the circumferential surface. In such an embodiment, the cavities are preferably guided axially and have an opening on one end face of the measuring pulley body, or transverse channels are provided within the measuring pulley body which lead radially from the cavity further into the interior of the measuring pulley body, for example to a collecting channel in the center of the measuring pulley body. A closed circumferential surface of the measuring pulley body can further be achieved in that, in embodiments in which the respective cavity has a cavity leading in the direction of the circumferential surface, these are closed by a closure element. Such a closure element can be a sheath tube completely surrounding a base body of the measuring pulley body, as shown for example in FIGS. 3 and 4 of DE 10 2014 012 426 A1. However, the closure element can also be designed in the manner of the cover shown in DE 197 47 655 A1. In a preferred embodiment, however, the measuring pulley does not have a sheath tube, but is designed as a solid pulley, either one in which no cavity leads from it to the circumferential surface, or one in which the respective cavity is a cavity which leads in the direction of the circumferential surface, but which is closed by a closing element, such as a cover. In addition, coatings, for example of the circumferential surface of a solid pulley or the circumferential surface of a shell tube, are conceivable, for example to reduce friction or to protect the strip-shaped material to be guided over the measuring pulley.

At least one cavity is provided in the body of the measuring pulley. It has been shown that the advantages of the invention can be achieved with only one cavity in the measuring pulley body. In case of flatness measurement, for example, it will be credible when information about the flatness of the strip-shaped material which is passed over the measuring pulley once per revolution of the measuring pulley.

In a preferred embodiment, the measuring pulley body has multiple cavities. In a preferred embodiment, the cavities are designed at the same radial distance from the longitudinal axis of the measuring pulley body. In a preferred embodiment, all cavities are arranged equidistantly to each other in the circumferential direction. However, embodiments are also conceivable when a first group of cavities is provided, which are in particular preferably arranged at the same radial distance from the longitudinal axis and distributed equidistantly in the circumferential direction, and in which, in addition to this first group of recesses, at least one further cavity is provided which is either designed differently with respect to its radial distance from the longitudinal axis than the cavities of the first group and/or does not have the same distance in the circumferential direction from the other cavities as the other cavities have from one another. For example, it is conceivable to design a measuring pulley with regard to flatness measurement in the same way as a measuring pulley of the prior art, for example like the solid pulley known from DE 102 07 501 or the measuring pulleys known from DE 10 2014 012 426 A1, but then to provide these measuring pulleys of the prior art for further equipment with a further cavity designed outside the grid, with which for example a different measurement is carried out. Preferably, the cavities mentioned in this paragraph are those that run in the axial direction of the measuring pulley body. embodiments are also conceivable in which the measuring pulley has a single cavity, and all force sensors of the measuring pulley are arranged in a single cavity, for example in a single axially extending recess.

In a preferred embodiment, the measuring pulley body has a closed circumferential surface and is closed off at each end by an end face. In a preferred embodiment, the end faces are arranged at an angle of 90° to the circumferential surface.

In a preferred embodiment, the measuring pulley has bearing pivots. In a preferred embodiment, the bearing pivots are formed on the end faces in embodiments of the measuring pulley with end faces.

In a preferred embodiment, the measuring pulley body is cylindrical in shape.

In a preferred embodiment, the measuring pulley is designed with at least one cavity in the measuring pulley body, which is arranged at a distance from the circumferential surface, wherein the cavity does not open towards the circumferential surface, or no further cavity continuing from the recess, for example no bore, leads to the circumferential surface. In an alternative preferred embodiment, the cavity leads from the peripheral surface into the interior of the measuring pulley body, but is closed by a closure element. In a preferred embodiment, in those embodiments in which the measuring pulley is designed with several cavities in the measuring pulley body that are arranged at a distance from the circumferential surfaces, either all recesses are designed in such a way that no recess, e.g. no bore leads from the cavity to the circumferential surface (and also the cavity itself does not open into the circumferential surface), or some recesses are designed in such a way that no cavity leads from the respective cavity to the circumferential surface, while in other cavities a cavity leading in the direction of the circumferential surface is provided, which is, however, closed by a closure element. The closure element is—as explained above—a cover or, for example, a jacket tube.

In a preferred embodiment, a cavity of the measuring pulley body extends in a direction parallel to the longitudinal axis of the measuring pulley body. If, according to a preferred embodiment, several cavities are provided in the measuring pulley body, it is preferred that all cavities of the measuring pulley body each extend in a direction parallel to the longitudinal axis of the measuring pulley body. In a preferred embodiment, the respective cavity opens at least at one of its ends, preferably at both of its ends, onto an end face of the measuring pulley body. A cavity ending at an end face of a measuring pulley body can be closed by an end cap, whereby this end cap only closes this cavity. Likewise, embodiments are conceivable in which the end face of the measuring pulley body is completely closed by a cover, as shown for example in FIGS. 1 and 2, or FIG. 4 of DE 10 2014 012 426 A1.

In a preferred embodiment, the cavity is elongated, wherein "elongated" is understood to mean that the cavity is larger in a first direction (in the longitudinal direction of the recess) than in any direction perpendicular to that direction. In a preferred embodiment, the extent of the elongated cavity is two times, or more preferably more than two times greater in the longitudinal direction than in any direction perpendicular to that direction. In a preferred embodiment, the longitudinal direction of the cavity includes an angle with the longitudinal direction of the measuring pulley body that is less than 75°, more preferably <45°, more preferably <30°, more preferably <10°, more preferably <5°. In a preferred embodiment, the longitudinal direction of the cavity is not perpendicular to the longitudinal axis of the measuring pulley body. If—which would be conceivable in one embodiment—the longitudinal axis of the cavity and the longitudinal axis of the measuring pulley body do not intersect, the above design rule applies to the projection of the longitudinal axis of the cavity onto the level containing the longitudinal axis of the measuring pulley body. Accordingly, in these embodiments, the projection of the longitudinal axis of the cavity onto a level containing the longitudinal axis of the measuring pulley body is such that the projection of the longitudinal direction of the cavity forms an angle with the longitudinal direction of the measuring pulley body.n longitudinal direction of the measuring pulley body encloses an angle which is smaller than 75°, in particular preferably <45°, in particular preferably <30°, in particular preferably <10°, in particular preferably <5°. In the preferred embodiments in which the recess extends parallel to the longitudinal axis of the measuring pulley body, the longitudinal axis of the cavity obviously does not intersect the longitudinal axis of the measuring pulley body, nor does a projection of the longitudinal axis onto a level containing the longitudinal axis of the measuring pulley body intersect the longitudinal axis of the measuring pulley body. DE 20 2007 001 066 U1, for example, shows a measuring pulley with elongated cavities.

In a preferred embodiment, the flatness measuring pulley has an axial bore running parallel to the first pulley axis, with the force sensor being arranged in the axial bore. According to the invention, the flatness measuring pulley is no longer influenced by torsional forces, or only to a small extent. This also allows pulley designs to be used in which the sensors are used not only in radial bores but also in axial bores, as described for example in EP 1 469 955 A1.

In a preferred embodiment, the flatness measuring pulley has a surface coating. In particular, the flatness measuring pulley preferably has a coating of tungsten carbide or chromium. Also, the surface coating can be rubber or polyurethane coating.

In this description, reference is made to a first tensioning pulley and a second tensioning pulley, and in the context of preferred embodiments, to a third tensioning pulley, a fourth tensioning pulley, and in some cases even to a fifth and a sixth tensioning pulley of a Tensioning pulley set. The use of the ordinal numbers "first", "second", "third", "fourth", "fifth" and "sixth" does not necessarily mean, but only in a preferred embodiment, that the belt passing through the set of tensioning pulleys is guided over the existing tensioning pulleys in the order of their ordinal numbers, i.e. first over the first tensioning pulley and then over the second tensioning pulley, etc. The invention is first directed to the realization that within a set of tensioning pulleys there a tensioning pulley with a drive (the so-called "second tensioning pulley") is provided and, in addition, a flatness measuring pulley designated as "first tensioning pulley", which is drive-less or equipped with an auxiliary drive. The invention does not initially specify the spatial position of the first tensioning pulley and the second tensioning pulley relative to each other. It is not essential to achieving the advantages of the invention that the flatness measuring pulley (the "first idler") be the spatially first idler over which the belt passes when the belt enters the idler set. It is also not essential for achieving the advantages of the invention that the "second tensioning pulley" is the immediate tensioning pulley downstreaming the flatness measuring pulley (the "first tensioning pulley") in the direction of the belt movement. Thus, it is also possible that the embodiments in which the flatness measuring pulley (the "first tensioning pulley") is the last tensioning pulley of a tensioning pulley set or a tensioning pulley arranged between the foremost tensioning pulley and the last tensioning pulley of a tensioning pulley set. Likewise, embodiments are possible in which further tension pulleys, possibly driven but also possibly non-driven tension pulleys, are provided between the flatness measuring pulley (the "first tension pulley") and the driven, second tension pulley.

In a preferred embodiment, however, the second tensioning pulley is the tensioning pulley of the tensioning pulley set over which the belt is guided after it leaves the first tensioning pulley designed as a flatness measuring pulley. In a particularly preferred embodiment, the first tensioning pulley designed as a flatness measuring pulley is the tensioning pulley of the tensioning pulley set onto which the belt first runs when it enters the tensioning pulley set. In a preferred embodiment, in which a third tensioning pulley is provided, this third tensioning pulley is arranged downstream of the second tensioning pulley in the direction of the belt movement, in particular preferably immediately downstream. In a preferred embodiment, in which a fourth tensioning pulley is provided, this fourth tensioning pulley is arranged downstream of the third tensioning pulley in the direction of belt's movement, in particular preferably immediately downstream. In a preferred embodiment, in which a fifth tensioning pulley is provided, this fifth tensioning pulley is arranged downstream of the fourth tensioning pulley in the direction of belt's movement, in particular preferably immediately downstream. In a preferred embodiment, in which a sixth tensioning pulley is provided, this sixth tensioning pulley is arranged downstream of the fifth tensioning pulley in the direction of belt movement, in particular preferably immediately downstream.

The preferred arrangement of the individual tension pulleys described in the preceding paragraph is particularly suitable for embodiments in which the tension pulley is set according to the invention is to be arranged downstream of a stretching zone or downstream of a bending stand and it is desired to document the flatness quality with which the strip leaves the stretching zone or the bending stand. This preferred arrangement is also suitable for a set of tension pulleys downstream of an un-coiler, where there is a desire to document the flatness quality with which the strip leaves the coiler.

In a preferred, alternative embodiment, however, the first tension pulley designed as a flatness measuring pulley is the tension pulley of the set over which the belt is guided after it leaves the second tension pulley. In a particularly preferred embodiment, the first tensioning pulley, which is designed as a flatness measuring pulley, is the tensioning pulley of the set from which the belt runs off last when it leaves the tensioning pulley set. In this preferred embodiment, the first tensioning pulley designed as a flatness measuring pulley is thus the last tensioning pulley of the tensioning pulley set. In a preferred embodiment, in which a third tensioning pulley is provided, this third tensioning pulley is connected upstream of the second tensioning pulley in the direction of the belt's movement, in particular preferably directly upstream. In a preferred embodiment, in which a fourth tensioning pulley is provided, this fourth tensioning pulley is connected upstream of the third tensioning pulley in the direction of the belt movement, in particular preferably directly upstream. In a preferred embodiment, in which a fifth tensioning pulley is provided, this fifth tensioning pulley is connected upstream of the fourth tensioning pulley in the direction of belt movement, in particular preferably directly upstream. In a preferred embodiment, in which a sixth tensioning pulley is provided, this sixth tensioning pulley is connected upstream of the fifth tensioning pulley in the direction of belt's movement, in particular and preferably directly upstream.

The preferred arrangement of the individual tension pulleys described in the preceding paragraph is particularly suitable for embodiments in which the tensioning pulley set according to the invention is to be arranged upstream of a take-up reel and there is a desire to document the flatness quality with which the strip is wound onto the take-up reel. This preferred arrangement is also suitable for a set of tension pulleys to be placed in front of a stretching zone or a bending stand, and it is desired to document with which flatness quality the strip enters the stretching zone or the bending stand.

The invention provides a drive for the second tensioning pulley, which can be used to apply a torque to the second tensioning pulley on the second pulley axis. Such a drive is in particular preferably equipped with an electric motor and a gearbox with which adjustable torques can be generated. The drive applies the torque, in particular preferably on one side, to one of the bearing pivots of the tensioning pulley. In a preferred embodiment, the drive is designed to apply a maximum torque from the range of 1-100 kNm to the idler pulley.

In a preferred embodiment, the first tensioning pulley is designed without a drive and all other existing tensioning pulleys are designed driven. In a preferred embodiment, the first tensioning pulley has an auxiliary drive and all other tensioning pulleys present are also of the driven type.

In a first embodiment of the tensioning pulley set according to the invention, the first tensioning pulley, which is designed as a flatness measuring pulley, is designed without a drive. In this embodiment of the tensioning pulley set according to the invention, no drive is provided for the first tensioning pulley with which a torque can be applied to the first tensioning pulley on the first pulley axis. The first tensioning pulley is thus designed as a drag pulley.

In the alternative provided in accordance with the invention, an auxiliary drive is indeed provided for the first tensioning pulley, with which a torque can be applied to the first tensioning pulley on the first pulley axis. However, this auxiliary drive for the first tensioning pulley is weaker than the drive for the second tensioning pulley. While the drive for the second tensioning pulley is designed in such a way that it can be used, following the basic idea of a tensioning pulley set, to increase or decrease the tension in the belt, an auxiliary drive for the first tensioning pulley may be necessary to rotate the first tensioning pulley when the straightener is started up, thus enabling the belt to be threaded and, if necessary, to accelerate and decelerate the pulley. However, such an auxiliary drive is not necessary for the actual operation of the straightening unit and, in a preferred embodiment of the process according to the invention, is switched off after a start-up phase or it is controlled to a torque of 0 Nm.

In a preferred embodiment, the auxiliary drive is an order of magnitude weaker than the drive for the second tensioning pulley. In a preferred embodiment, the auxiliary drive can generate a maximum torque that is in the range of 0.03 to 0.3 kNm.

In a preferred embodiment, a third tensioning pulley is provided with a third pulley axis. In particular, a drive for the third tensioning pulley is preferably provided, with which a torque can be applied to the third tensioning pulley on the third pulley axis. In a preferred embodiment, the drive for the third tensioning pulley can generate a maximum torque that is at least twice greater than the maximum torque that the drive for the second tensioning pulley can generate. This applies in particular to applications in which, in the sequence in which the strip runs over the tensioning pulleys, the third tensioning pulley is closer to a stretching zone, a bending stand or a re-rolling stand than the second tensioning pulley. In a preferred embodiment, the drive for the third tensioning pulley can generate a maximum torque that is at least half less than the maximum torque that the drive for the second tensioning pulley can generate. This applies in particular to applications in which, in the sequence in which the strip runs over the tensioning pulleys, the second tensioning pulley is closer to a stretching zone, a bending stand or a re-rolling stand than the third tensioning pulley.

In a preferred embodiment, a fourth tensioning pulley is provided with a fourth pulley axis. In particular, a drive for the fourth tensioning pulley is preferably provided, with which a torque can be applied to the fourth tensioning pulley on the fourth pulley axis. In a preferred embodiment, the drive for the fourth tensioning pulley can generate a maximum torque that is at least twice greater than the maximum torque that the drive for the third tensioning pulley can generate. This applies in particular to applications in which, in the sequence in which the strip runs over the tensioning pulleys, the fourth tensioning pulley is closer to a stretching zone, a bending stand or a re-rolling stand than the third tensioning pulley. In a preferred embodiment, the drive for the fourth idler pulley can generate a maximum torque that is at least half less than the maximum torque that the drive for the third idler pulley can generate. This applies in particular to applications in which, in the sequence in which the strip runs over the tensioning pulleys, the third tensioning pulley is closer to a stretching zone, a bending stand or a re-rolling stand than the fourth tensioning pulley.

In a preferred embodiment, a fifth tensioning pulley is provided with a fifth pulley axis. In particular, a drive for the fifth tensioning pulley is preferably provided, with which a torque can be applied to the fifth tensioning pulley on the fifth pulley axis. In a preferred embodiment, the drive for the fifth tensioning pulley can generate a maximum torque that is at least twice greater than the maximum torque that the drive for the fourth tensioning pulley can generate. This applies in particular to applications in which the sequence in which the strip runs over the tensioning pulleys, the fifth tensioning pulley is closer to a stretching zone, a bending stand or a re-rolling stand than the fourth tensioning pulley. In a preferred embodiment, the drive for the fifth tensioning pulley can generate a maximum torque that is at least half less than the maximum torque that the drive for the fourth tensioning pulley can generate. This applies in particular to applications in which, in the sequence in which the strip runs over the tensioning pulleys, the fourth tensioning pulley is closer to a stretching zone, a bending stand or a re-rolling stand than the fifth tensioning pulley.

In a preferred embodiment, a sixth tensioning pulley is provided with a sixth pulley axis. In particular, a drive for the sixth tensioning pulley is preferably provided, with which a torque can be applied to the sixth tensioning pulley on the sixth pulley axis. In a preferred embodiment, the drive for the sixth idler can generate a maximum torque that is at least twice greater than the maximum torque that the drive for the fifth idler can generate. This applies in particular to applications in which, in the sequence in which the strip runs over the tensioning pulleys, the sixth tensioning pulley is closer to a stretching zone, a bending stand or a re-rolling stand than the fifth tensioning pulley. In a preferred embodiment, the drive for the sixth tensioning pulley can generate a maximum torque that is at least half less than the maximum torque that the drive for the fifth tensioning pulley can generate. This applies in particular to applications in which, in the sequence in which the strip runs over the tensioning pulleys, the fifth tensioning pulley is closer to a stretching zone, a bending stand or a re-rolling stand than the sixth tensioning pulley.

In a preferred embodiment, the drive for the second idler can apply a maximum torque T2 on the second idler axis to the second idler and the auxiliary drive for the first idler can apply a maximum torque T1 on the first idler axis to the first idler, wherein T1 is equal to or less than ⅞ of T2, more preferably equal to or less than ¾ of T2, most preferably equal to or less than half of T2, most preferably equal to or less than ⅛ of T2, most preferably equal to or less than 1/10 of T2.

In a preferred embodiment, the second tensioning pulley is arranged relative to the first tensioning pulley in such a way that the level which is perpendicular to the horizontal and which contains the second pulley axis, as seen in the direction of a run-up direction in which the belt is to run onto the tensioning pulley set according to the invention, lies in front of the level which is

- is perpendicular to the horizontal,
- is arranged downstream of the first pulley axis of the first tensioning pulley in the run-up direction, and
- tangential to the surface of the first tensioning pulley.

In a preferred embodiment, the second pulley axis is arranged in a horizontal level that lies below a horizontal level in which the first pulley axis is arranged.

In a preferred embodiment that includes a third tensioning pulley, the second tensioning pulley and the third tensioning pulley are arranged relative to the first tensioning pulley such that

- the level which is perpendicular to the horizontal and which contains the second pulley axis lies on one side of a level which is perpendicular to the horizontal and tangential to the surface of the first tensioning pulley, and
- the level perpendicular to the horizontal and containing the third pulley axis lies on the other side of the level perpendicular to the horizontal and tangential to the surface of the first idler.

In this embodiment, a fourth tensioning pulley is in particular preferably also provided, the fourth pulley axis being in particular preferably arranged between the first pulley axis and the third pulley axis, viewed in the horizontal direction.

In a preferred embodiment, the first pulley axis and the second pulley axis are aligned parallel to each other. In a preferred embodiment, all pulley axes of the tensioning pulleys of the tensioning pulley set are designed parallel to each other. In a preferred embodiment, when viewed in a horizontal direction, the second pulley axis is located in front of the first pulley axis, the fourth pulley axis is located after the first pulley axis, and the third pulley axis is located after the fourth pulley axis. In a particularly preferred embodiment, the fifth pulley axis is arranged after the third pulley axis. In a particularly preferred embodiment, a sixth pulley axis is arranged between the fifth pulley axis and the third pulley axis.

In the straightening device according to the invention for straightening a strip, a front tensioning pulley set and a rear tensioning pulley set are provided. A stretching zone can be provided between the front tensioning pulley set and the rear tensioning pulley set. A bending frame can be provided between the front idler set and the rear idler set. A stretching zone and a bending stand can be provided between the front tensioning pulley set and the rear tensioning pulley set.

According to the invention, the front tensioning pulley set can be designed as a tensioning pulley set according to the invention or the rear tensioning pulley set can be designed as a tensioning pulley set according to the invention. Likewise, according to the invention, both the front tensioning pulley set and the rear tensioning pulley set can be designed as a tensioning pulley set according to the invention.

In a preferred embodiment, a further flatness measuring pulley is provided before the front tensioning pulley set and/or after the front tensioning pulley set and/or before the rear tensioning pulley set and/or after the rear tensioning pulley set. In a particularly preferred alternative, no further flatness measuring pulley is provided before the front tensioning pulley set and/or after the front tensioning pulley set and/or before the rear tensioning pulley set and/or after the rear tensioning pulley set.

If the first tensioning pulley designed as a flatness measuring pulley is the first tensioning pulley of the rear tensioning pulley set onto which the belt runs when it leaves the stretching zone or the bending stand, the flatness of the belt can be determined immediately after it leaves the stretching zone or after it leaves the bending stand. If the first tensioning pulley designed according to the invention as a flatness measuring pulley is designed as the last tensioning pulley of the front tensioning pulley set over which the strip runs before it leaves the front tensioning pulley set, the flatness of the strip can be determined by this arrangement immediately before the strip enters the stretching zone or immediately before the strip enters the bending stand.

However, embodiments in which there is an interest in the flatness with which the strip enters the straightening plant according to the invention or the flatness with which it leaves the straightening plant according to the invention are also credible Therefore, embodiments in which the first tensioning pulley designed as a flatness measuring pulley is the first tensioning pulley of the front tensioning pulley set onto which the belt runs when it enters the front tensioning pulley set are also expedient. In such an embodiment, the flatness measuring pulley according to the invention can be used to determine the flatness of the strip as it leaves the reel. Likewise, a embodiment may be appropriate in which the first tensioning pulley, designed as a flatness measuring pulley, is the last tensioning pulley of the rear tensioning pulley set over which the belt runs before it leaves the rear tensioning pulley set. With such an arrangement of the flatness measuring pulley, the flatness of the strip can be determined before it runs onto the reel.

More preferably, the invention is carried out according to one of the embodiments listed below:

Thereby in the table below it is meant that:

| In front of the idler set | In the front of the idler set | after the front set of tensioning pulleys, but before the stretching zone, or before the bending stand | Before the rear tensioning pulley set, but after the stretching zone, or after the bending stand | In the rear idler set | after the rear idler set |
|---|---|---|---|---|---|
| None | None | None | None | (1) | None |
| None | None | None | None | (2) | None |
| None | None | None | None | (3) | None |
| None | None | None | None | (4) | None |
| None | None | None | One | (1) | None |
| None | None | None | One | (2) | None |
| None | None | None | One | (3) | None |
| None | None | None | One | (4) | None |
| None | None | None | None | (1) | One |
| None | None | None | None | (2) | One |
| None | None | None | None | (3) | One |
| None | None | None | None | (4) | One |
| None | None | None | One | (1) | One |
| None | None | None | One | (2) | One |
| None | None | None | One | (3) | One |
| None | None | None | One | (4) | One |
| None | (1) | None | None | (1) | None |
| None | (1) | None | None | (2) | None |
| None | (1) | None | None | (3) | None |
| None | (1) | None | None | (4) | None |
| None | (1) | None | One | (1) | None |
| None | (1) | None | One | (2) | None |
| None | (1) | None | One | (3) | None |
| None | (1) | None | One | (4) | None |
| None | (1) | None | None | (1) | One |
| None | (1) | None | None | (2) | One |
| None | (1) | None | None | (3) | One |
| None | (1) | None | None | (4) | One |
| None | (1) | None | One | (1) | One |
| None | (1) | None | One | (2) | One |
| None | (1) | None | One | (3) | One |
| None | (1) | None | One | (4) | One |
| None | (2) | None | None | (1) | None |
| None | (2) | None | None | (2) | None |
| None | (2) | None | None | (3) | None |
| None | (2) | None | None | (4) | None |
| None | (2) | None | One | (1) | None |
| None | (2) | None | One | (2) | None |
| None | (2) | None | One | (3) | None |
| None | (2) | None | One | (4) | None |
| None | (2) | None | None | (1) | None |
| None | (2) | None | None | (2) | None |
| None | (2) | None | None | (3) | None |
| None | (2) | None | None | (4) | None |
| None | (2) | None | One | (1) | None |
| None | (2) | None | One | (2) | None |
| None | (2) | None | One | (3) | None |
| None | (2) | None | One | (4) | None |
| None | (3) | None | None | (1) | None |
| None | (3) | None | None | (2) | None |
| None | (3) | None | None | (3) | None |
| None | (3) | None | None | (4) | None |
| None | (3) | None | One | (1) | None |
| None | (3) | None | One | (2) | None |
| None | (3) | None | One | (3) | None |
| None | (3) | None | One | (4) | None |
| None | (3) | None | None | (1) | One |
| None | (3) | None | None | (2) | One |
| None | (3) | None | None | (3) | One |
| None | (3) | None | None | (4) | One |
| None | (3) | None | One | (1) | One |
| None | (3) | None | One | (2) | One |
| None | (3) | None | One | (3) | One |
| None | (3) | None | One | (4) | One |
| None | (4) | None | None | (1) | None |
| None | (4) | None | None | (2) | None |
| None | (4) | None | None | (3) | None |
| None | (4) | None | None | (4) | None |
| None | (4) | None | One | (1) | None |
| None | (4) | None | One | (2) | None |
| None | (4) | None | One | (3) | None |
| None | (4) | None | One | (4) | None |
| None | (4) | None | None | (1) | One |
| None | (4) | None | None | (2) | One |
| None | (4) | None | None | (3) | One |
| None | (4) | None | None | (4) | One |
| None | (4) | None | One | (1) | One |
| None | (4) | None | One | (2) | One |
| None | (4) | None | One | (3) | One |
| None | (4) | None | One | (4) | One |
| One | None | None | None | (1) | None |
| One | None | None | None | (2) | None |
| One | None | None | None | (3) | None |
| One | None | None | None | (4) | None |
| One | None | None | One | (1) | None |
| One | None | None | One | (2) | None |
| One | None | None | One | (3) | None |
| One | None | None | One | (4) | None |
| One | None | None | None | (1) | One |
| One | None | None | None | (2) | One |
| One | None | None | None | (3) | One |
| One | None | None | None | (4) | One |
| One | None | None | One | (1) | One |
| One | None | None | One | (2) | One |
| One | None | None | One | (3) | One |
| One | None | None | One | (4) | One |
| One | (1) | None | None | (1) | None |
| One | (1) | None | None | (2) | None |
| One | (1) | None | None | (3) | None |
| One | (1) | None | None | (4) | None |
| One | (1) | None | One | (1) | None |
| One | (1) | None | One | (2) | None |
| One | (1) | None | One | (3) | None |
| One | (1) | None | One | (4) | None |
| None | (1) | None | None | (1) | One |
| None | (2) | None | None | (2) | One |
| None | (3) | None | None | (3) | One |
| None | (4) | None | None | (4) | One |
| None | (1) | None | One | (1) | One |
| None | (2) | None | One | (2) | One |
| None | (3) | None | One | (3) | One |
| None | (4) | None | One | (4) | One |

-continued

| In front of the idler set | In the front of the idler set | after the front set of tensioning pulleys, but before the stretching zone, or before the bending stand | Before the rear tensioning pulley set, but after the stretching zone, or after the bending stand | In the rear idler set | after the rear idler set |
|---|---|---|---|---|---|
| One | (1) | None | None | (3) | One |
| One | (1) | None | None | (4) | One |
| One | (1) | None | One | (1) | One |
| One | (1) | None | One | (2) | One |
| One | (1) | None | One | (3) | One |
| One | (1) | None | One | (4) | One |
| One | (2) | None | None | (1) | None |
| One | (2) | None | None | (2) | None |
| One | (2) | None | None | (3) | None |
| One | (2) | None | None | (4) | None |
| One | (2) | None | One | (1) | None |
| One | (2) | None | One | (2) | None |
| One | (2) | None | One | (3) | None |
| One | (2) | None | One | (4) | None |
| One | (2) | None | None | (1) | One |
| One | (2) | None | None | (2) | One |
| One | (2) | None | None | (3) | One |
| One | (2) | None | None | (4) | One |
| One | (2) | None | One | (1) | One |
| One | (2) | None | One | (2) | One |
| One | (2) | None | One | (3) | One |
| One | (2) | None | One | (4) | One |
| One | (3) | None | None | (1) | None |
| One | (3) | None | None | (2) | None |
| One | (3) | None | None | (3) | None |
| One | (3) | None | None | (4) | None |
| One | (3) | None | One | (1) | None |
| One | (3) | None | One | (2) | None |
| One | (3) | None | One | (3) | None |
| One | (3) | None | One | (4) | None |
| One | (3) | None | None | (1) | One |
| One | (3) | None | None | (2) | One |
| One | (3) | None | None | (3) | One |
| One | (3) | None | None | (4) | One |
| One | (3) | None | One | (1) | One |
| One | (3) | None | One | (2) | One |
| One | (3) | None | One | (3) | One |
| One | (3) | None | One | (4) | One |
| One | (4) | None | None | (1) | None |
| One | (4) | None | None | (2) | None |
| One | (4) | None | None | (3) | None |
| One | (4) | None | None | (4) | None |
| One | (4) | None | One | (1) | None |
| One | (4) | None | One | (2) | None |
| One | (4) | None | One | (3) | None |
| One | (4) | None | One | (4) | None |
| One | (4) | None | None | (1) | One |
| One | (4) | None | None | (2) | One |
| One | (4) | None | None | (3) | One |
| One | (4) | None | None | (4) | One |
| One | (4) | None | One | (1) | One |
| One | (4) | None | One | (2) | One |
| One | (4) | None | One | (3) | One |
| One | (4) | None | One | (4) | One |
| None | None | One | None | (1) | None |
| None | None | One | None | (2) | None |
| None | None | One | None | (3) | None |
| None | None | One | None | (4) | None |
| None | None | One | One | (1) | None |
| None | None | One | One | (2) | None |
| None | None | One | One | (3) | None |
| None | None | One | One | (4) | None |
| None | None | One | None | (1) | One |
| None | None | One | None | (2) | One |
| None | None | One | None | (3) | One |
| None | None | One | None | (4) | One |
| None | None | One | One | (1) | One |
| None | None | One | One | (2) | One |
| None | None | One | One | (3) | One |
| None | None | One | One | (4) | One |
| None | (1) | One | None | (1) | None |

-continued

| In front of the idler set | In the front of the idler set | after the front set of tensioning pulleys, but before the stretching zone, or before the bending stand | Before the rear tensioning pulley set, but after the stretching zone, or after the bending stand | In the rear idler set | after the rear idler set |
|---|---|---|---|---|---|
| None | (1) | One | None | (2) | None |
| None | (1) | One | None | (3) | None |
| None | (1) | One | None | (4) | None |
| None | (1) | One | One | (1) | None |
| None | (1) | One | One | (2) | None |
| None | (1) | One | One | (3) | None |
| None | (1) | One | One | (4) | None |
| None | (1) | One | None | (1) | One |
| None | (1) | One | None | (2) | One |
| None | (1) | One | None | (3) | One |
| None | (1) | One | None | (4) | One |
| None | (1) | One | One | (1) | One |
| None | (1) | One | One | (2) | One |
| None | (1) | One | One | (3) | One |
| None | (1) | One | One | (4) | One |
| None | (2) | One | None | (1) | None |
| None | (2) | One | None | (2) | None |
| None | (2) | One | None | (3) | None |
| None | (2) | One | None | (4) | None |
| None | (2) | One | One | (1) | None |
| None | (2) | One | One | (2) | None |
| None | (2) | One | One | (3) | None |
| None | (2) | One | One | (4) | None |
| None | (2) | One | None | (1) | One |
| None | (2) | One | None | (2) | One |
| None | (2) | One | None | (3) | One |
| None | (2) | One | None | (4) | One |
| None | (2) | One | One | (1) | One |
| None | (2) | One | One | (2) | One |
| None | (2) | One | One | (3) | One |
| None | (2) | One | One | (4) | One |
| None | (3) | One | None | (1) | None |
| None | (3) | One | None | (2) | None |
| None | (3) | One | None | (3) | None |
| None | (3) | One | None | (4) | None |
| None | (3) | One | One | (1) | None |
| None | (3) | One | One | (2) | None |
| None | (3) | One | One | (3) | None |
| None | (3) | One | One | (4) | None |
| None | (3) | One | None | (1) | One |
| None | (3) | One | None | (2) | One |
| None | (3) | One | None | (3) | One |
| None | (3) | One | None | (4) | One |
| None | (3) | One | One | (1) | One |
| None | (3) | One | One | (2) | One |
| None | (3) | One | One | (3) | One |
| None | (3) | One | One | (4) | One |
| None | (4) | One | None | (1) | None |
| None | (4) | One | None | (2) | None |
| None | (4) | One | None | (3) | None |
| None | (4) | One | None | (4) | None |
| None | (4) | One | One | (1) | None |
| None | (4) | One | One | (2) | None |
| None | (4) | One | One | (3) | None |
| None | (4) | One | One | (4) | None |
| None | (4) | One | None | (1) | One |
| None | (4) | One | None | (2) | One |
| None | (4) | One | None | (3) | One |
| None | (4) | One | None | (4) | One |
| None | (4) | One | One | (1) | One |
| None | (4) | One | One | (2) | One |
| None | (4) | One | One | (3) | One |
| None | (4) | One | One | (4) | One |
| One | None | One | None | (1) | None |
| One | None | One | None | (2) | None |
| One | None | One | None | (3) | None |
| One | None | One | None | (4) | None |
| One | None | One | One | (1) | None |
| One | None | One | One | (2) | None |
| One | None | One | One | (3) | None |
| One | None | One | One | (4) | None |

-continued

| In front of the idler set | In the front of the idler set | after the front set of tensioning pulleys, but before the stretching zone, or before the bending stand | Before the rear tensioning pulley set, but after the stretching zone, or after the bending stand | In the rear idler set | after the rear idler set |
|---|---|---|---|---|---|
| One | None | One | None | (1) | One |
| One | None | One | None | (2) | One |
| One | None | One | None | (3) | One |
| One | None | One | None | (4) | One |
| One | None | One | One | (1) | One |
| One | None | One | One | (2) | One |
| One | None | One | One | (3) | One |
| One | None | One | One | (4) | One |
| One | (1) | One | None | (1) | None |
| One | (1) | One | None | (2) | None |
| One | (1) | One | None | (3) | None |
| One | (1) | One | None | (4) | None |
| One | (1) | One | One | (1) | None |
| One | (1) | One | One | (2) | None |
| One | (1) | One | One | (3) | None |
| One | (1) | One | One | (4) | None |
| One | (1) | One | None | (1) | One |
| One | (1) | One | None | (2) | One |
| One | (1) | One | None | (3) | One |
| One | (1) | One | None | (4) | One |
| One | (1) | One | One | (1) | One |
| One | (1) | One | One | (2) | One |
| One | (1) | One | One | (3) | One |
| One | (1) | One | One | (4) | One |
| One | (2) | One | None | (1) | None |
| One | (2) | One | None | (2) | None |
| One | (2) | One | None | (3) | None |
| One | (2) | One | None | (4) | None |
| One | (2) | One | One | (1) | None |
| One | (2) | One | One | (2) | None |
| One | (2) | One | One | (3) | None |
| One | (2) | One | One | (4) | None |
| One | (2) | One | None | (1) | One |
| One | (2) | One | None | (2) | One |
| One | (2) | One | None | (3) | One |
| One | (2) | One | None | (4) | One |
| One | (2) | One | One | (1) | One |
| One | (2) | One | One | (2) | One |
| One | (2) | One | One | (3) | One |
| One | (2) | One | One | (4) | One |
| One | (3) | One | None | (1) | None |
| One | (3) | One | None | (2) | None |
| One | (3) | One | None | (3) | None |
| One | (3) | One | None | (4) | None |
| One | (3) | One | One | (1) | None |
| One | (3) | One | One | (2) | None |
| One | (3) | One | One | (3) | None |
| One | (3) | One | One | (4) | None |
| One | (3) | One | None | (1) | One |
| One | (3) | One | None | (2) | One |
| One | (3) | One | None | (3) | One |
| One | (3) | One | None | (4) | One |
| One | (3) | One | One | (1) | One |
| One | (3) | One | One | (2) | One |
| One | (3) | One | One | (3) | One |
| One | (3) | One | One | (4) | One |
| One | (4) | One | None | (1) | None |
| One | (4) | One | None | (2) | None |
| One | (4) | One | None | (3) | None |
| One | (4) | One | None | (4) | None |
| One | (4) | One | One | (1) | None |
| One | (4) | One | One | (2) | None |
| One | (4) | One | One | (3) | None |
| One | (4) | One | One | (4) | None |
| One | (4) | One | None | (1) | One |
| One | (4) | One | None | (2) | One |
| One | (4) | One | None | (3) | One |
| One | (4) | One | None | (4) | One |

-continued

| In front of the idler set | In the front of the idler set | after the front set of tensioning pulleys, but before the stretching zone, or before the bending stand | Before the rear tensioning pulley set, but after the stretching zone, or after the bending stand | In the rear idler set | after the rear idler set |
|---|---|---|---|---|---|
| One | (4) | One | One | (1) | One |
| One | (4) | One | One | (2) | One |
| One | (4) | One | One | (3) | One |
| One | (4) | One | One | (4) | One |

None = No flatness measuring pulley is provided at this location

One = One flatness measuring pulley is provided at this location (1) = a first tensioning pulley of this tensioning pulley set is designed as a flatness measuring pulley, the first tensioning pulley is arranged at any place in the tensioning pulley set (2) = a first tensioning pulley of this tensioning pulley set is designed as a flatness measuring pulley, the first tensioning pulley is the tensioning pulley on which the belt runs on first (3) = a first tensioning pulley of this tensioning pulley set is designed as a flatness measuring pulley, the first tensioning pulley is the last tensioning pulley of the tensioning pulley set from which the belt runs (4) = the tensioning pulley set has two tensioning pulleys designed as flatness measuring pulleys The combination of a flatness measuring pulley provided in the tensioning pulley set with a flatness measuring pulley upstream and/or downstream of the tensioning pulley set has the disadvantage that more installation space is required for such a embodiment; however, providing a separate tensioning pulley in addition to the one provided in the tensioning pulley set can offer the advantage of being able to calibrate the flatness measuring pulley in the tensioning pulley set.

In a preferred embodiment, a belt is guided over the first tensioning pulley and over the second tensioning pulley, wherein the belt wraps around the first tensioning pulley with a wrap angle of at least 90°, in particular preferably at least 125°, in particular preferably at least 130°, in particular preferably at least 145°, in particular preferably at least 180°;

and/or the belt wraps around the second tensioning pulley with a wrap angle of at least 90°, in particular preferably at least 125°, in particular preferably at least 130°, in particular preferably at least 145°, in particular preferably at least 180°.

In a preferred embodiment of the straightening system according to the invention, the same number of driven tension pulleys are provided in the front tensioning pulley set as in the rear tensioning pulley set. In a preferred embodiment, the front and rear tensioning pulley sets have the same number of tensioning pulleys, whereby the first tensioning pulley, designed as a flatness measuring pulley, is designed without a drive and is arranged either in the front or in the rear tensioning pulley set, whereby the other tensioning pulley set does not have a flatness measuring pulley but instead of the flatness measuring pulley has a drag pulley, and the remaining tensioning pulleys of the respective tensioning pulley set are driven, so that the same number of driven tensioning pulleys is provided in the front tensioning pulley set as in the rear tensioning pulley set.

In a preferred embodiment, the rear tensioning pulley set of the straightening unit is a tensioning pulley set according to the invention, wherein the first tension pulley is the tension pulley of the tensioning pulley set onto which the strip runs after leaving the stretching zone and/or the bending stand. Supplementary or alternatively, the front tensioning pulley set of the straightening unit is a tensioning pulley set according to the invention, wherein the first tension pulley is the tension pulley of the tensioning pulley set from which the strip enters the stretching zone and/or the bending stand. Alternatively, in a further preferred embodiment, the front tensioning pulley set of the straightening machine is a tensioning pulley set according to the invention, wherein the first tension pulley is the tension pulley of the tensioning pulley set onto which the strip from an uncoiler runs.

With the straightening system according to the invention, it is possible to carry out the flatness measurement at the smallest possible distance behind the stretching zone or bending stand. This minimizes the dead leg. The invention enables the flatness measuring pulley in the high tensile range without interference from the pulley drive. The flatness measurement can be carried out in the straightening plant in the tension area with only one measuring pulley. The straightening device according to the invention allows flatness measuring pulley diameters to be made with the same size as the other tensioning pulleys of the tensioning pulley set. This allows bending stresses to be minimized when the strip is deflected around the pulley body.

The set of tension pulleys according to the invention can also be used in a re-rolling stand for re-rolling a strip. The re-rolling stand has a. A front idler set, b. a rear idler set, c. a re-rolling stand provided between the front tensioning pulley set and the rear tensioning pulley set, whereby the front tensioning pulley set is designed as a tensioning pulley set according to the invention and/or the rear tensioning pulley set is designed as a tensioning pulley set according to the invention.

The foregoing disclosure for embodiments of the straightening plant according to the invention is also intended to serve as a disclosure for embodiments of the re-rolling stand plant according to the invention, wherein the disclosure for the re-rolling stand plant is formed by replacing the term "straightening plant" by "re-rolling stand plant" and the term "stretching zone" by roll stand and the term "bending stand" by roll stand.

A method according to the invention for operating a straightening plant according to the invention, which has a bending stand with an adjustable bending roll and a control device, provides that the control device carries out control interventions on at least one actuator of the straightening plant, for example the adjustable bending roll or the tensioning roll sets, on the basis of measurement results of the force sensor.

A method according to the invention for operating a re-rolling stand system according to the invention, which has an adjustable roll and a control device, provides that the control device carries out control interventions on at least one actuator of the re-rolling stand system, for example the adjustable roll or the tensioning pulley sets, on the basis of measurement results of the force sensor.

A supplementary or alternative method according to the invention for operating a straightening plant according to the invention or a re-rolling stand plant according to the invention, which is designed in such a way that an auxiliary drive for the first tensioning pulley is provided, with which a torque on the first pulley axis can be applied to the first tensioning pulley, wherein the auxiliary drive for the first tensioning pulley is weaker than the drive for the second tensioning pulley, provides that after a start-up phase and/or after build-up of the strip tension, the auxiliary drive for the first tensioning pulley is switched off or is regulated to a drive torque of 0 Nm.

The start-up phase includes in particular the threading of the belt and the acceleration of the line up to operating speed.

With the set of tension pulleys according to the invention, the process according to DE 10 2019 006 788 can be carried out.

In particular, the invention preferably finds application in the straightening and/or re-rolling of strip material, preferably of metal strips or of metal sheets.

BRIEF DESCRIPTION OF DRAWINGS

In the following, the invention is explained more closely with the aid of drawings showing merely realizations. Shown are.

DETAILED DESCRIPTION

Figure 1:
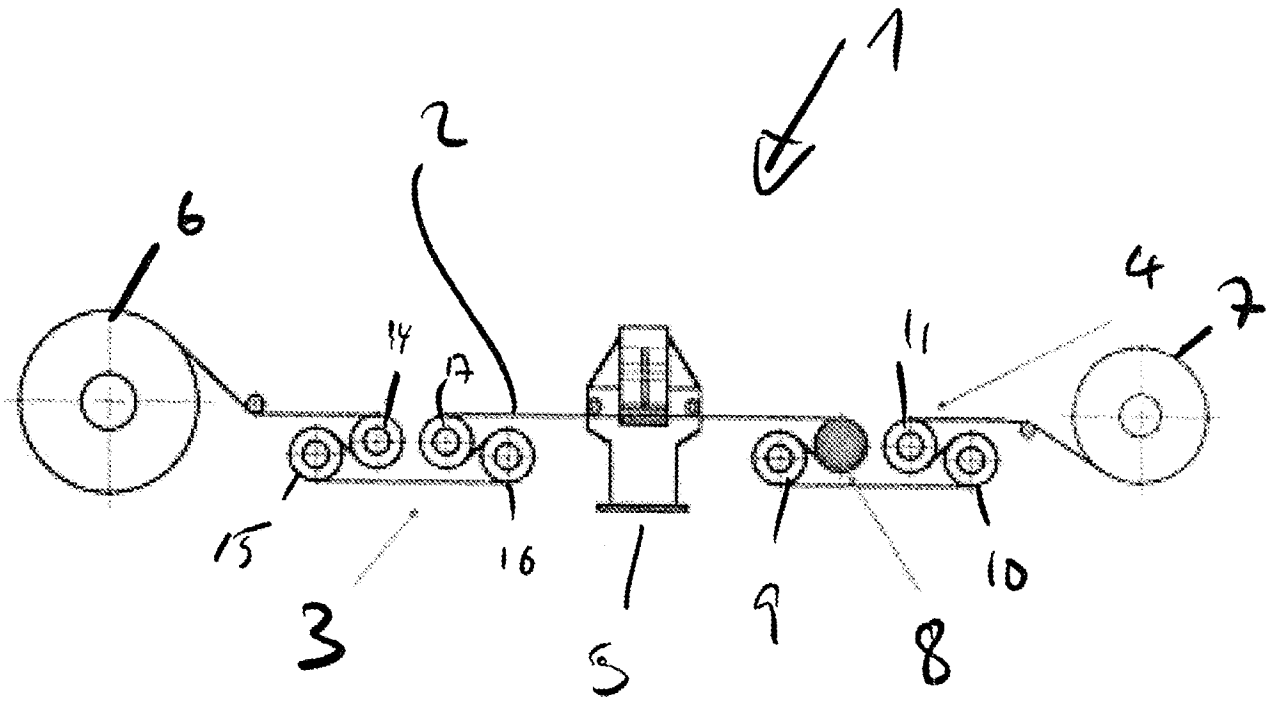
FIG. 1 a schematic side view of a straightening machine according to the invention.

The straightening unit 1 shown in FIG. 1 for straightening a strip 2 has a front tensioning pulley set 3 and a rear tensioning pulley set 4. A bending frame 5 is provided between the front idler set 3 and the rear idler set 4. A reel 6 is provided in front of the front idler set 3. A reel 7 is provided behind the rear idler set 4.

The strip 2 is uncoiled from the reel 6, passes through the front set of tension pulleys 3, passes through the bending stand 5, passes through the rear set of tension pulleys 4 and is coiled up by the reel 7. In the front tensioning pulley set 3, the belt tension acting on the belt 2 is increased, while in the rear tensioning pulley set 4, the belt tension acting on the belt 2 is reduced, so that the belt tension acting on the belt 2 in the area of the bending stand 5 higher than before the front tensioning pulley set 3 and after the rear tensioning pulley set 4.

The rear tensioning pulley set 4 has a first tensioning pulley 8 with a first pulley axis, a second tensioning pulley 9 with a second pulley axis, a third tensioning pulley 10 with a third pulley axis, a fourth tensioning pulley 11 with a fourth pulley axis, wherein the first tension pulley 8 is a flatness measuring pulley having a force sensor for measuring a radial force (FR,1) applied to the circumferential surface of the flatness measuring pulley.

a drive (not shown in more detail) for the second tensioning pulley 9 is provided, with which a torque can be applied to the second tensioning pulley 9 on the second pulley axis. Furthermore, a drive (also not shown in more detail) is provided for the third tensioning pulley 10, with which a torque can be applied to the third tensioning pulley 10 on the third pulley axis. Furthermore, a drive (also not shown in more detail) is provided for the fourth tensioning pulley 11, with which a torque can be applied to the fourth tensioning pulley 11 on the fourth pulley axis.

The first tensioning pulley 8 is designed without a drive.

The front idler set 3 has a first tensioning pulley 14 with a first pulley axis, a second tensioning pulley 15 with a second pulley axis, a third tensioning pulley 16 with a third pulley axis, a fourth tensioning pulley 17 with a fourth pulley axis, on. a drive (not shown in more detail) for the second tensioning pulley 15 is provided, with which a torque can be applied to the second tensioning pulley 15 on the second pulley axis. Furthermore, a drive (also not shown in more detail) is provided for the third tensioning pulley 16, with which a torque can be applied to the third tensioning pulley 16 on the third pulley axis. Furthermore, a drive (also not shown in more detail) is provided for the fourth tensioning pulley 17, with which a torque can be applied to the fourth tensioning pulley 17 on the fourth pulley axis.

The first tensioning pulley 14 is designed without a drive.

Figure 2:
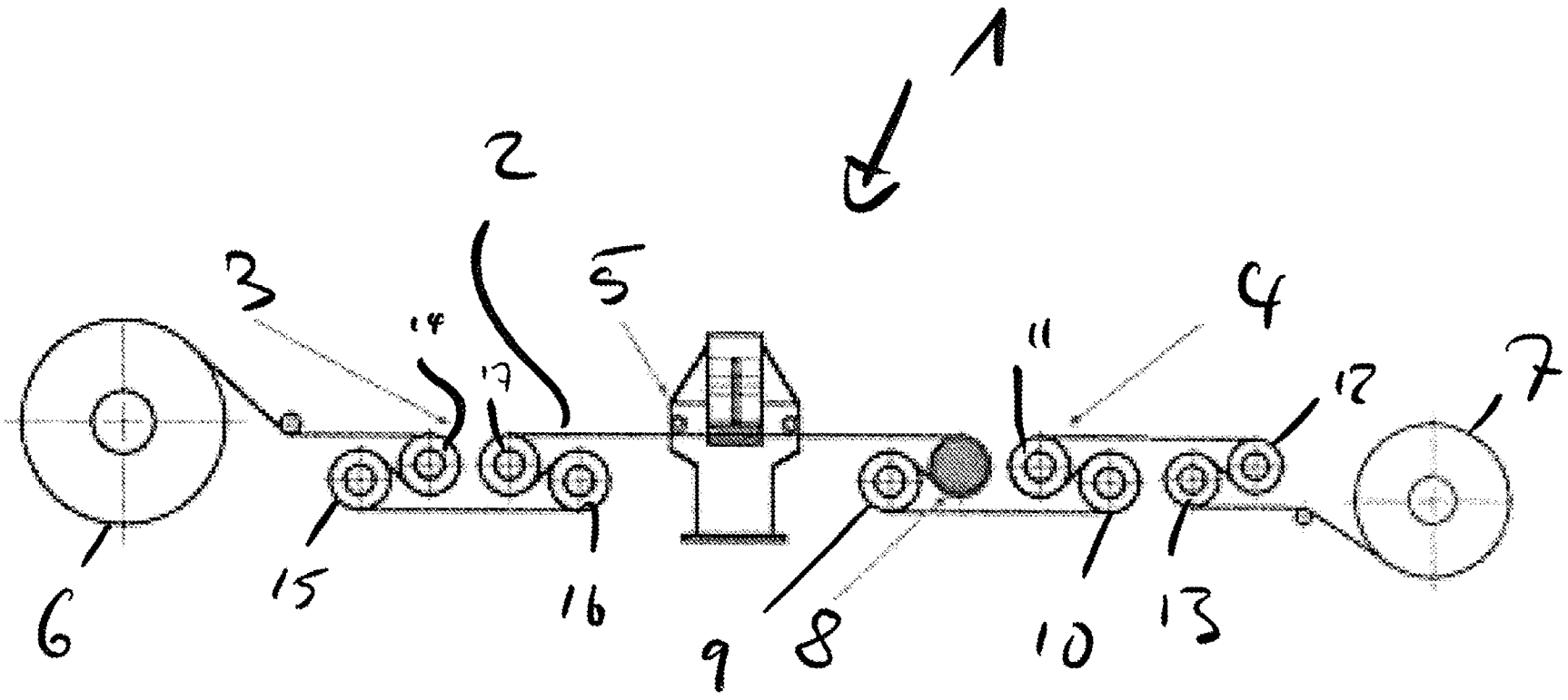
FIG. 2 a schematic side view of a further straightening system according to the invention, and FIG. 3 a schematic representation of the forces acting on a measuring pulley.

The straightening unit 1 shown in FIG. 2 differs from the straightening unit 1 shown in FIG. 1 in the design of the rear tensioning pulley set 4 and the design of the front tensioning pulley set 3. In addition to the first tensioning pulley 8, the second tensioning pulley 9, the third tensioning pulley 10 and the fourth tensioning pulley 11, this has a fifth tensioning pulley 12 and a sixth tensioning pulley 13.

a drive (not shown in more detail) for the second tensioning pulley 9 is provided, with which a torque can be applied to the second tensioning pulley 9 on the second pulley axis. Furthermore, a drive (also not shown in more detail) is provided for the third tensioning pulley 10, with which a torque can be applied to the third tensioning pulley 10 on the third pulley axis. Furthermore, a drive (also not shown in more detail) is provided for the fourth tensioning pulley 11, with which a torque can be applied to the fourth tensioning pulley 11 on the fourth pulley axis. Furthermore, a drive (also not shown in more detail) for the fifth tensioning pulley 12 is provided, with which a torque can be applied to the fifth tensioning pulley 12 on the fifth pulley axis.

The first tensioning pulley 8 and the sixth tensioning pulley 13 are designed without a drive.

The front tensioning pulley set 3 in the embodiment of FIG. 2 has a first tensioning pulley 14 with a first pulley axis, a second tensioning pulley 15 with a second pulley axis, a third tensioning pulley 16 with a third pulley axis, a fourth tensioning pulley 17 with a fourth pulley axis, on. a drive (not shown in more detail) for the second tensioning pulley 15 is provided, with which a torque can be applied to the second tensioning pulley 15 on the second pulley axis. Furthermore, a drive (also not shown in more detail) is provided for the third tensioning pulley 16, with which a torque can be applied to the third tensioning pulley 16 on the third pulley axis. Furthermore, a drive (also not shown in more detail) is provided for the fourth tensioning pulley 17, with which a torque can be applied to the fourth tensioning pulley 17 on the fourth pulley axis. Furthermore, a drive (also not shown in more detail) is provided for the first tensioning pulley 14, with which a torque can be applied to the first tensioning pulley 14 on the first pulley axis.

Figure 3:
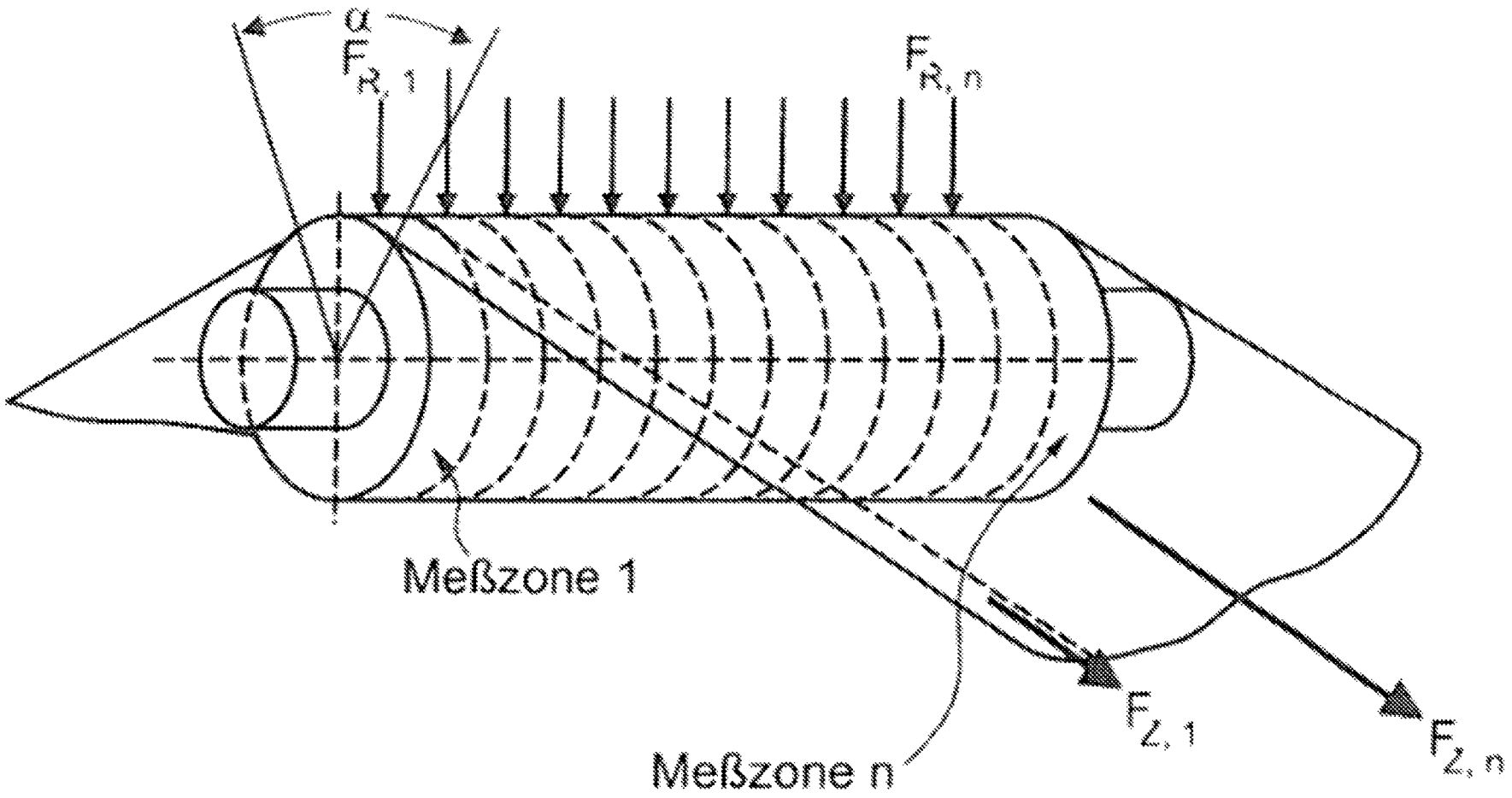

FIG. 3 shows the forces applied to the measuring pulley by a metal strip partially wrapped around the measuring pulley and under tension. The quartz force sensors arranged in the cavities in the measuring pulley generate electrical charge. This is directly proportional to the force applied to the quartz.

The strip length deviation, usually measured in 1-units and commonly used as a representative of strip flatness, can be calculated based on the following relationships:

Local tensile stress in strip section i $$\sigma_{Z,i}=F_{R,i}\times r_Roll/(A_Sensor\times d)$$

with

F_R,i=Local radial force in N (sensor force)

r_Roll=Radius of the measuring pulley

A_Sensor=area of the sensor or the cover on the sensor that is in contact with the tape.

d=strip thickness

Tensile stress deviation of the belt section from belt section with maximum tensile stress:

$$\Delta\sigma_{Z,i}=\sigma_{Z,l}-\sigma_{Z,max}$$

with $\sigma_{Z,max}$=maximum of all local tensile stresses

Local strip length deviation (flatness):

$$\Delta L/Li=-\Delta\sigma_{Z,i}/E$$

with

E=E-modulus

EXAMPLE

FR,i=500 N r_Roll=300 mm

A_Sensor=707 $mm^2$ d=0.5 mm $\sigma_{Z,l}$=424.4 MPa $\sigma_{Z,max}$=430 MPa $\Delta\sigma_{Z,l}$=−5.59 MPa E=206 GPa ΔL/1i=27.1 μm/m=2.71 l-units.

The invention claimed is:

1. A tensioning pulley set for a straightening line for straightening a strip or for a re-rolling stand for re-rolling a strip, the tensioning pulley set comprising:

a first tensioning pulley having a first pulley axis, the first tensioning pulley being a flatness measuring pulley having a force sensor for measuring a radial force exerted on a circumferential surface of the flatness measuring pulley; and a second tensioning pulley with a second pulley axis, and a drive for the second tensioning pulley with which a torque can be applied to the second tensioning pulley on the second pulley axis;

wherein the first tensioning pulley is configured without a drive.

2. The tensioning pulley set according to claim 1, further comprising a third tensioning pulley having a third pulley axis and a fourth tensioning pulley having a fourth pulley axis, wherein:

a. a drive is provided for the third tensioning pulley with which a torque can be applied to the third tensioning pulley on the third pulley axis; and/or b. a drive is provided for the fourth tensioning pulley with which a torque can be applied to the fourth tensioning pulley on the fourth pulley axis.

3. The tensioning pulley set according to claim 2, further comprising a fifth tensioning pulley having a fifth pulley axis, wherein a drive for the fifth tensioning pulley is provided by which a torque on the fifth pulley axis can be applied to the fifth tensioning pulley.

4. The tensioning pulley set according to claim 1, wherein the flatness measuring pulley has an axial bore running parallel to the first pulley axis, and wherein the force sensor is arranged in the axial bore.

5. The tensioning pulley set according to claim 4, wherein the flatness measuring pulley has a surface coating.

6. The tensioning pulley set according to claim 1, further comprising a belt guided over the first tensioning pulley and over the second tensioning pulley, the belt wrapping around at least one of: a) the first tensioning pulley with a wrap angle of at least 90°, and b) the second tensioning pulley with a wrap angle of at least 90°.

7. A straightening unit for straightening a strip, comprising:

a front tensioning pulley set;

a rear tensioning pulley set;

a stretching zone between the front tensioning pulley set and the rear tensioning pulley set; and/or a bending stand between the front tensioning pulley set and the rear tensioning pulley set;

wherein the front tensioning pulley set and/or the rear tensioning pulley set comprises:

a first tensioning pulley having a first pulley axis, the first tensioning pulley being a flatness measuring pulley having a force sensor for measuring a radial force exerted on a circumferential surface of the flatness measuring pulley; and a second tensioning pulley with a second pulley axis, and a drive for the second tensioning pulley with which a torque can be applied to the second tensioning pulley on the second pulley axis;

wherein the first tensioning pulley is configured without a drive.

8. The straightening unit according to claim 7, wherein the rear tensioning pulley set is a tensioning pulley set having a first tensioning pulley with a first pulley axis, a second tensioning pulley with a second pulley axis, a third tensioning pulley with a third pulley axis, and a fourth tensioning pulley with a fourth pulley axis, the first tensioning pulley being the tensioning pulley of the tensioning pulley set on which a belt first runs up; and/or the front tensioning pulley set is a tensioning pulley set having a first tensioning pulley with a first pulley axis, a second tensioning pulley with a second pulley axis, a third tensioning pulley with a third pulley axis, a fourth tensioning pulley with a fourth pulley axis, and wherein the first tensioning pulley is the tensioning pulley of the front tensioning pulley set from which the belt runs off last.

9. The straightening unit according to claim 7, wherein the rear tensioning pulley set is a tensioning pulley set having a first tensioning pulley with a first pulley axis, a second tensioning pulley with a second pulley axis, a third tensioning pulley with a third pulley axis, and a fourth tensioning pulley with a fourth pulley axis, the first tensioning pulley being the tensioning pulley of the tensioning pulley set on which a belt first runs up; and the front tensioning pulley set is a tensioning pulley set having a first tensioning pulley with a first pulley axis, a second tensioning pulley with a second pulley axis, a third tensioning pulley with a third pulley axis, a fourth tensioning pulley with a fourth pulley axis, and wherein the first tensioning pulley is the tensioning pulley of the front tensioning pulley set from which the belt runs off last.

10. A re-rolling stand for the re-rolling of a strip comprising:

a. a front tensioning pulley set;

b. a rear tensioning pulley set;

C. a re-rolling stand provided between the front tensioning pulley set and the rear tensioning pulley set;

wherein the front tensioning pulley set and/or the rear tensioning comprises:

a first tensioning pulley having a first pulley axis, the first tensioning pulley being a flatness measuring pulley having a force sensor for measuring a radial force exerted on a circumferential surface of the flatness measuring pulley; and a second tensioning pulley with a second pulley axis, and a drive for the second tensioning pulley with which a torque can be applied to the second tensioning pulley on the second pulley axis;

wherein the first tensioning pulley is configured without a drive.

11. The re-rolling stand according to claim 10, wherein the front tensioning pulley set is a tensioning pulley set having a first tensioning pulley with a first pulley axis, a second tensioning pulley with a second pulley axis, a third tensioning pulley with a third pulley axis, a fourth tensioning pulley with a fourth pulley axis; and the rear tensioning pulley set is a tensioning pulley set having a first tensioning pulley with a first pulley axis, a second tensioning pulley with a second pulley axis, a third tensioning pulley with a third pulley axis, and a fourth tensioning pulley with a fourth pulley axis.

* * * * *